US008851590B2

(12) United States Patent
Song et al.

(10) Patent No.: US 8,851,590 B2
(45) **Date of Patent: *Oct. 7, 2014**

(54) REFRIGERATOR HAVING SUB DOOR

(71) Applicant: Samsung Electronics Co., Ltd., Suwon-si (KR)

(72) Inventors: Joo Hee Song, Busan (KR); Jeong Wook Lee, Gwangju (KR); Ha Jin Jeong, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/083,002

(22) Filed: Nov. 18, 2013

(65) Prior Publication Data

US 2014/0070688 A1 Mar. 13, 2014

Related U.S. Application Data

(63) Continuation of application No. 12/805,918, filed on Aug. 24, 2010, now Pat. No. 8,607,584.

(30) Foreign Application Priority Data

Oct. 26, 2009 (KR) ..... 10-2009-0101910

(51) Int. Cl.

| | |
|---|---|
| ***A47B 96/04*** | (2006.01) |
| ***F25D 23/04*** | (2006.01) |
| ***F25D 23/02*** | (2006.01) |
| ***F25D 11/00*** | (2006.01) |

(52) U.S. Cl.

CPC ..... *F25D 23/04* (2013.01); *F25D 2303/085* (2013.01); *F25D 2400/06* (2013.01); *F25D 23/025* (2013.01); *F25D 11/006* (2013.01); *F25D 2323/023* (2013.01)

USPC ..... 312/405.1; 312/322

(58) Field of Classification Search

CPC ..... F25D 2303/085; F25D 2400/06; F25D 23/04; F25D 23/025; F25D 11/006; F25D 2323/023

USPC ..... 62/377, 438, 443, 382; 312/405, 405.1, 312/317.3, 321.5, 322, 271, 273–276, 327, 312/328; 49/103, 143, 166, 254

See application file for complete search history.

(56) References Cited

U.S. PATENT DOCUMENTS 2,136,558 A * 11/1938 Manshel ..... 62/266
2,401,613 A 6/1946 Charland (Continued)

OTHER PUBLICATIONS

U.S. Office Action issued Jun. 21, 2012 in copending U.S. Appl. No. 12/805,918.

(Continued)

*Primary Examiner* — Daniel Rohrhoff
(74) *Attorney, Agent, or Firm* — Staas & Halsey LLP

(57) ABSTRACT

A refrigerator includes a main body provided with storage chambers having doors, one of the doors being provided with an opening, the opening having at least one stepped plane; a rack installed in the storage chamber at a height corresponding to that of the lower end of the opening; a sub door to open and close the opening; and a connection member to prevent a height difference between a rear surface of the sub door and the opening. The connection member is configured to slide relative to the sub door to cover the at least one stepped plane, whereby the connection member closes the at least one stepped plane when the sub door is closed, and opens the at least one stepped plane when the sub door is opened so that the rear surface of the sub door and the connection member form substantially a level plane with the rack.

7 Claims, 6 Drawing Sheets

(56) References Cited

U.S. PATENT DOCUMENTS

| | | | | |
|---|---|---|---|---|
| 3,334,464 | A | 8/1967 | Charles | |
| 3,643,464 | A * | 2/1972 | Hilliker et al. | 62/344 |
| 4,087,140 | A * | 5/1978 | Linstromberg | 312/292 |
| 4,586,347 | A | 5/1986 | McCarty | |
| 5,048,233 | A | 9/1991 | Gidseg et al. | |
| 6,192,703 | B1 | 2/2001 | Salyer et al. | |
| 6,402,982 | B1 | 6/2002 | Salyer | |
| 6,637,235 | B2 | 10/2003 | Sakamoto et al. | |
| 6,971,730 | B2 | 12/2005 | Koons | |
| 7,040,113 | B2 | 5/2006 | Lee et al. | |
| 7,051,490 | B2 | 5/2006 | Oishi et al. | |
| 7,108,342 | B2 * | 9/2006 | Shin et al. | 312/405 |
| 7,254,958 | B2 * | 8/2007 | Kim et al. | 62/265 |
| 8,066,342 | B2 | 11/2011 | Hwang | |
| 8,607,584 | B2 * | 12/2013 | Song et al. | 62/377 |
| 2005/0132535 | A1 * | 6/2005 | Jang et al. | 16/357 |
| 2006/0103273 | A1 | 5/2006 | Lee et al. | |
| 2006/0119240 | A1 * | 6/2006 | Shin et al. | 312/405 |
| 2008/0018212 | A1 | 1/2008 | Spearing et al. | |
| 2008/0238279 | A1 | 10/2008 | Jang | |
| 2008/0278049 | A1 * | 11/2008 | Park et al. | 312/405 |
| 2009/0165497 | A1 | 7/2009 | Welch | |
| 2009/0179541 | A1 | 7/2009 | Smith et al. | |
| 2010/0084956 | A1 * | 4/2010 | Kim et al. | 312/405.1 |
| 2010/0287975 | A1 * | 11/2010 | Lim | 62/449 |

OTHER PUBLICATIONS

U.S. Office Action issued Mar. 18, 2013 in copending U.S. Appl. No. 12/805,918.

U.S. Notice of Allowance issued Aug. 21, 2013 in copending U.S. Appl. No. 12/805,918.

U.S. Appl. No. 12/805,918, filed Aug. 24, 2010, Joo Hee Song, Samsung Electronics Co., Ltd.

* cited by examiner

REFRIGERATOR HAVING SUB DOOR

CROSS-REFERENCE TO RELATED APPLICATIONS

This application is a continuation of U.S. application Ser. No. 12/805,918 filed on Aug. 24, 2010, which claims the benefit of Korean Patent Application No. 10-2009-0101910, filed on Oct. 26, 2009 in the Korean Intellectual Property Office, the disclosures of which are incorporated herein by reference.

BACKGROUND

1. Field

Embodiments relate to a refrigerator having a sub door which is installed on a main door so as to allow articles stored in a storage chamber to be withdrawn without opening of the main door and serves as a homebar door.

2. Description of the Related Art

In general, a refrigerator is an apparatus which stores frozen food and refrigerated food in a fresh state within storage chambers by controlling temperatures of the storage chambers by circulating cool air generated from a refrigerating cycle.

Doors to open and close the storage chambers rotated forwards are installed on a main body of such a refrigerator, and a homebar door (hereinafter, referred to as a sub door), through which articles stored in the storage chambers is withdrawn to the outside without opening of the doors, or, which is horizontally supported when the sub door is opened such that the stored articles are temporarily mounted on the sub door, is provided on the doors.

The conventional refrigerator having the sub door includes a receipt space provided on the rear surface of the door of the refrigerator and communicated with the outside through an opening formed through the door, the sub door installed at the opening such that the front end of the sub door is vertically rotatable about the lower end of the sub door so as to selectively open and close the receipt space, and stoppers provided on both side surfaces of the opening and supporting the lower ends of both sides of the rear surface of the sub door under the condition that the opening is opened so as to restrict the range of rotation of the sub door.

The above conventional refrigerator generates heat loss at the sub door, thus increasing energy loss compared with a refrigerator without a sub door. Further, the temperature of a portion around the sub door at the inside of the storage chamber is relatively high, and thus storage performance of the refrigerator is lowered.

SUMMARY

Therefore, it is an aspect to provide a refrigerator having a sub door which reduces energy loss.

It is another aspect to provide a refrigerator having a sub door which improves storage performance of a storage chamber.

It is a further aspect to provide a refrigerator having a sub door which transmits cool air to a stored article, if the sub door is opened and the article is placed on the opened sub door.

Additional aspects will be set forth in part in the description which follows and, in part, will be apparent from the description, or may be learned by practice of the invention.

In accordance with one aspect, a refrigerator includes a main body provided with storage chambers formed therein, doors opening and closing the storage chambers, and provided with an opening, a sub door to open and close the opening, and a cooling unit provided on the rear surface of the sub door.

The cooling unit may be made of a metal having a high heat capacity.

The cooling unit may be made of stainless steel.

The cooling unit may include a cold storage pack containing a liquid material, the phase of which is changeable.

The refrigerator may further include a rack installed in the storage chambers at a height corresponding to that of the lower end of the opening, and a connection member to prevent a height difference between the rear surface of the sub door and the opening when the sub door is opened.

The connection member may slide on the rear surface of the sub door based on opening and closing of the sub door.

The cooling unit may include a first stepped plane, and a second stepped plane lower than the first stepped plane, and the connection member may slide relative to the sub door and thus close the second stepped plane, when the sub door is closed, and may slide relative to the sub door and thus open the second stepped plane, when the sub door is opened.

The refrigerator may be a kimchi refrigerator to store kimchi.

The storage chambers provided in plural number may be vertically divided from each other, and the sub door may be provided on the door to open and close the upper storage chamber out of the plural storage chambers.

The storage chambers provided in plural number may be horizontally divided from each other, the number of the doors may be equal to the number of the storage chambers, and the sub door may be provided on at least one door of the doors.

The sub door may have a width corresponding to that of the doors.

In accordance with another aspect, a refrigerator includes a main body provided with storage chambers formed therein, doors opening and closing the storage chambers, and provided with an opening, and a sub door has a width corresponding to that of the doors so as to open and close the opening, wherein the sub door includes a first plane contacting the edge of the opening, a second plane protruded from the first plane and inserted into the opening, and a cooling unit provided on the second plane and made of a material having a higher heat capacity of an injection molded product.

In accordance with a further aspect, a manufacturing method of a sub door to open and close an opening of a door of a refrigerator includes preparing a frame having a size corresponding to the opening, and provided with front and rear openings on the front and rear surfaces thereof, fixing a front panel forming the front surface of the sub door to the edge of the front opening of the frame, fixing a cooling unit made of a material having a higher heat capacity than an injection molded product to the rear opening of the frame, and filling the inside of the sub door formed by the frame, the front panel, and the cooling unit with a foamed material so as to attach the frame, the front panel, and the cooling unit to each other by means of the foamed material.

The fixing of the front panel to the edge of the front opening of the frame may be achieved by attaching the front panel to the edge of the front opening using a double-sided adhesive tape.

The fixing of the cooling unit to the rear opening of the frame may be achieved by attaching the cooling unit to the edge of the rear opening using a double-sided adhesive tape

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
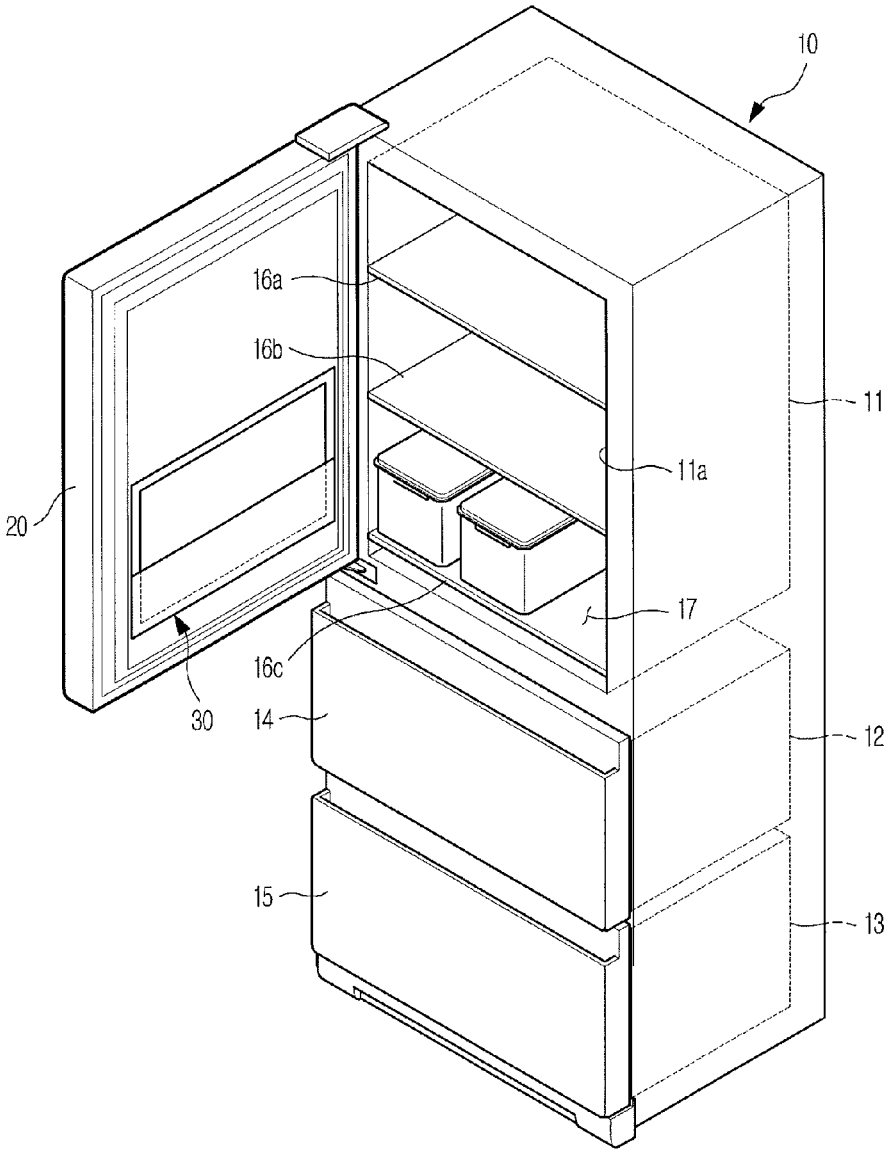
FIG. 1 is a perspective view illustrating a schematic configuration of a refrigerator in accordance with one embodiment.

Reference will now be made in detail to the embodiments, examples of which are illustrated in the accompanying drawings, wherein like reference numerals refer to like elements throughout.

Hereinafter, a refrigerator in accordance with one embodiment will be described with reference to the accompanying drawings.

Figure 2:
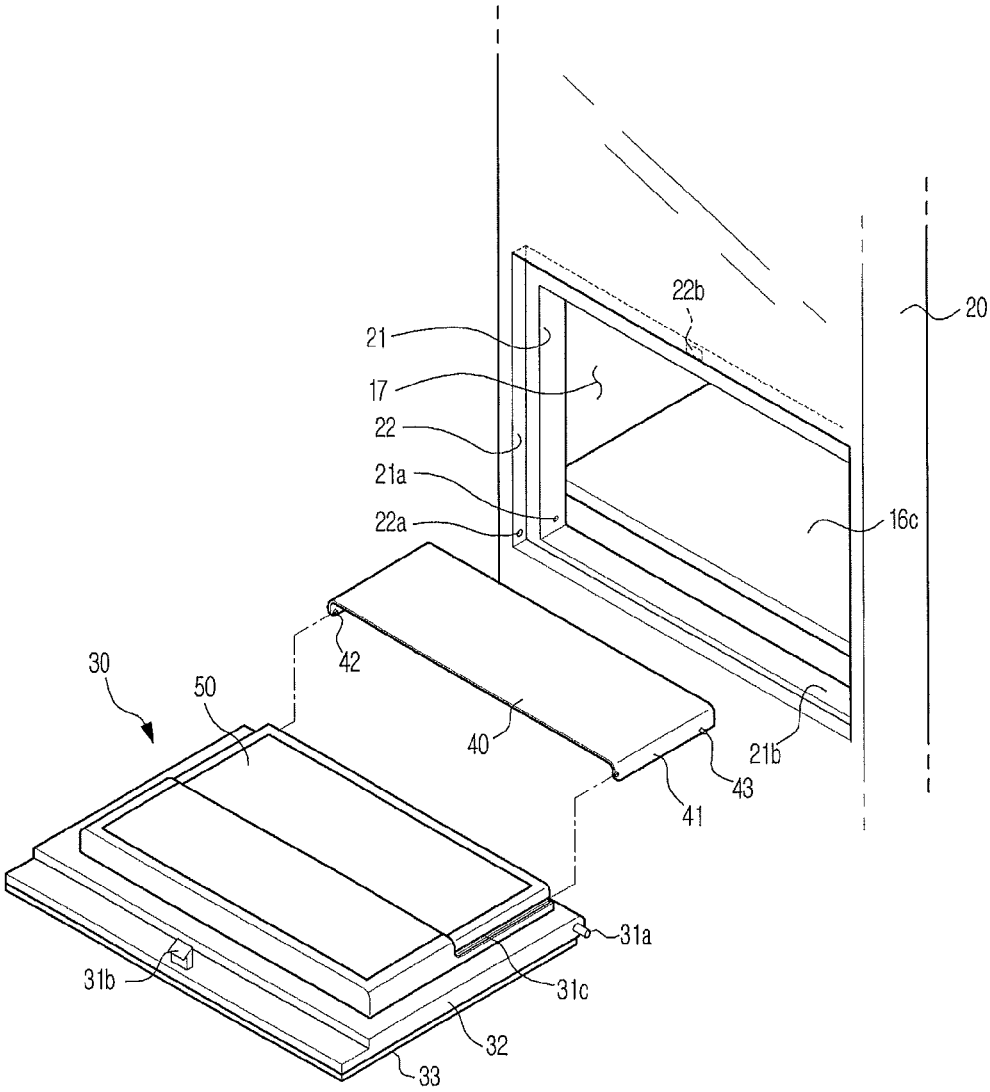
FIG. 2 is a perspective view of a main door of the refrigerator in accordance with the embodiment, from which a sub door is separated.
Figure 3:
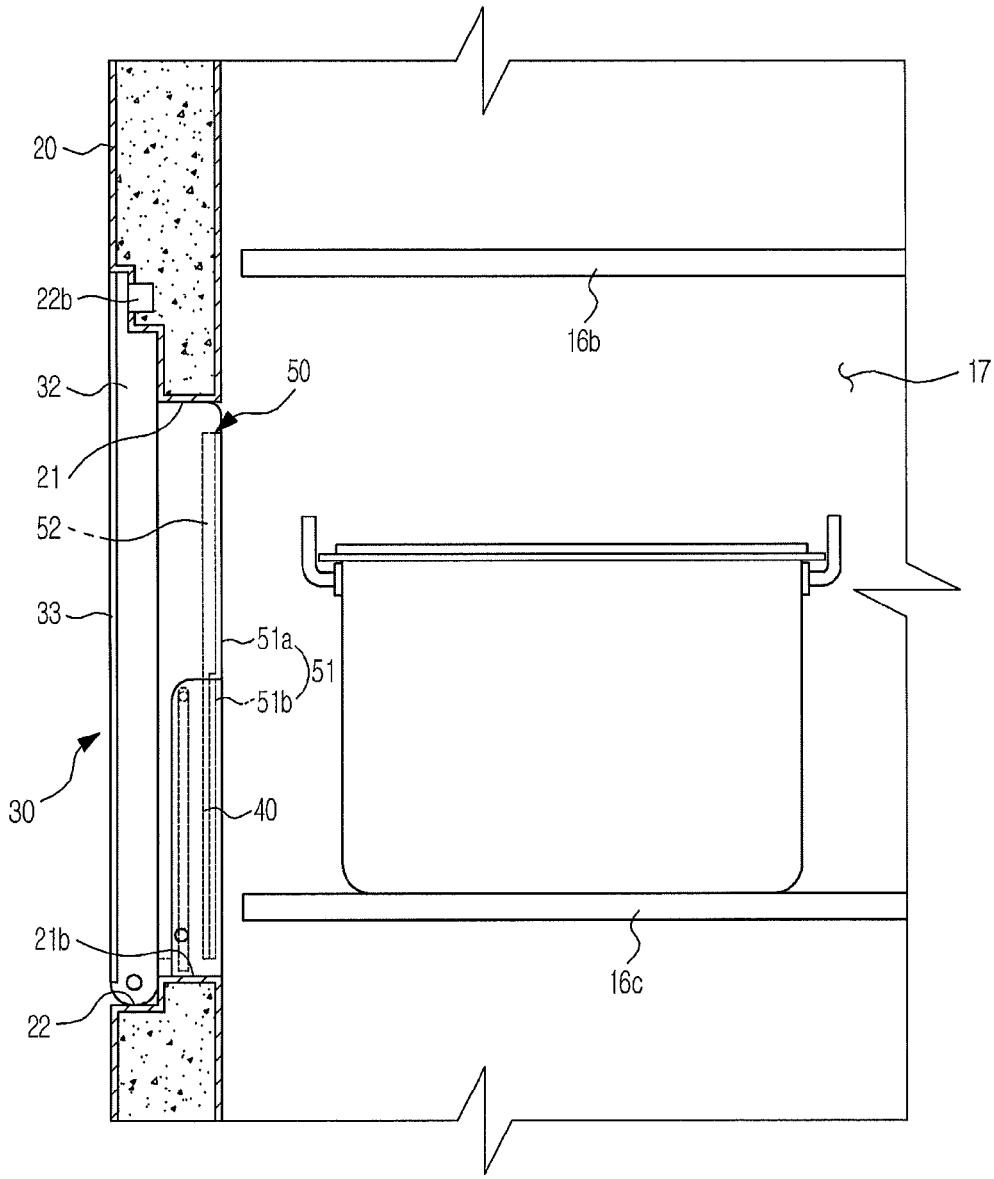
FIG. 3 is a longitudinal-sectional view of the refrigerator in accordance with the embodiment, illustrating the sub door in a closed state.

FIG. 1 is a perspective view illustrating a schematic configuration of a refrigerator in accordance with one embodiment, FIG. 2 is a perspective view of a main door of the refrigerator in accordance with the embodiment, from which a sub door is separated, and FIG. 3 is a longitudinal-sectional view of the refrigerator in accordance with the embodiment, illustrating the sub door in a closed state.

Figure 4:
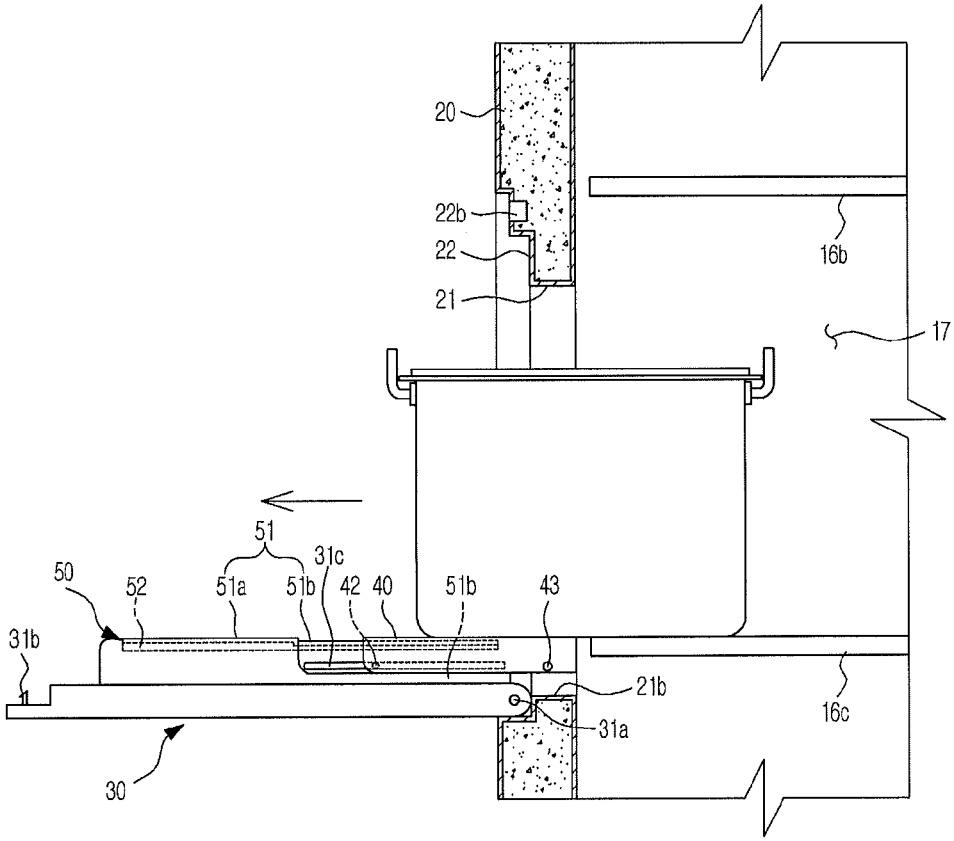
FIG. 4 is a longitudinal-sectional view of the refrigerator in accordance with the embodiment, illustrating the sub door in an opened state.
Figure 5:
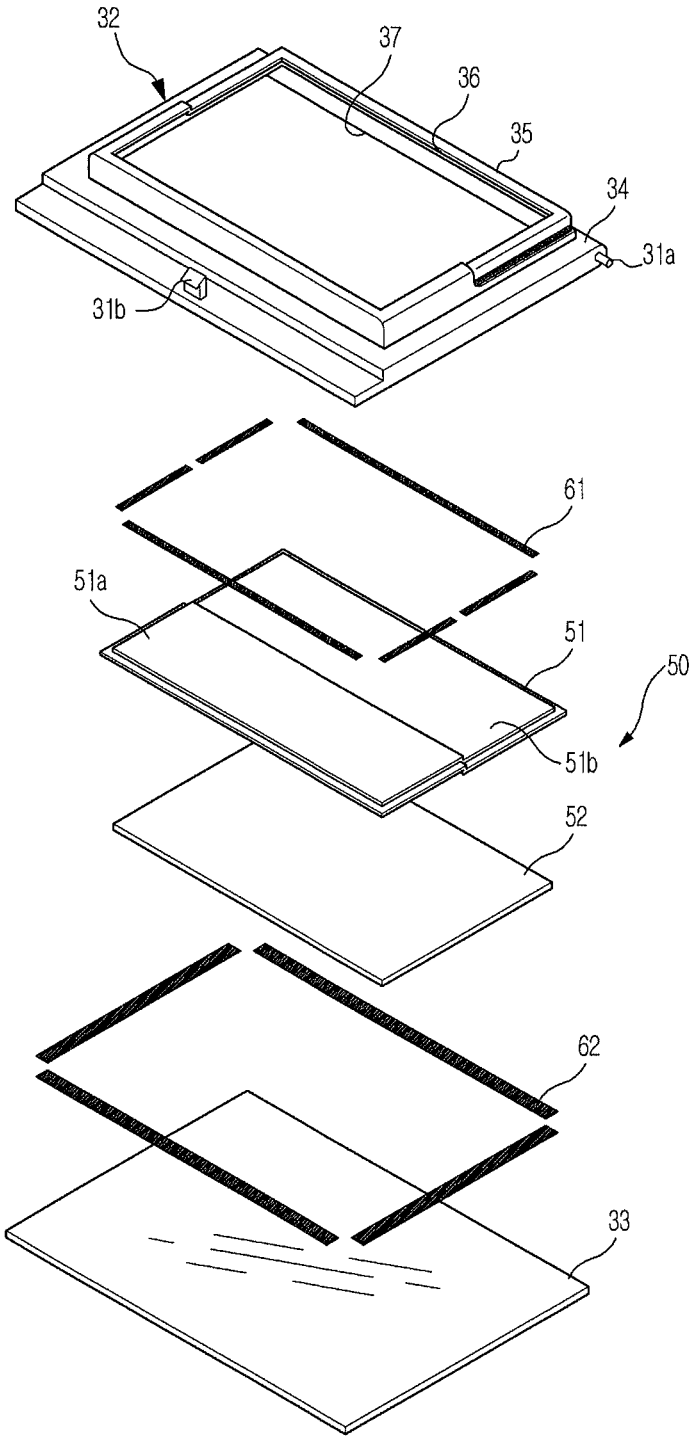
FIG. 5 is an exploded perspective view of the sub door illustrating a manufacturing method of the sub door in accordance with the embodiment.

FIG. 4 is a longitudinal-sectional view of the refrigerator in accordance with the embodiment, illustrating the sub door in an opened state, and FIG. 5 is an exploded perspective view of the sub door illustrating a manufacturing method of the sub door in accordance with the embodiment.

The refrigerator in accordance with this embodiment, as shown in FIG. 1, includes a main body 10, the inside of which is divided into storage chambers 11, 12, and 13, and the storage chambers 11, 12, and 13 within the main body 10 include an upper storage chamber 11, a central storage chamber 12, and a lower storage chamber 13, which are vertically divided from each other. First to third storage chamber doors 20, 14, and 15 to open and close the respective storage chambers 11, 12, and 13 are installed on the front surface of the main body 10.

The main body 10 is formed in a box shape filled with a urethane foamed material, and a machinery chamber (not shown) in which various electric components are installed is provided at a rear region of the lower portion of the main body 10. Components of a refrigerating cycle, such as a compressor (not shown), a condenser (not shown) to condense a refrigerant in a high-temperature and high-pressure state discharged from the compressor, and a control box (not shown), are installed in the machinery chamber in the same manner as a conventional refrigerator.

The refrigerator in accordance with this embodiment may be an indirect type refrigerator in which an evaporator (not shown) is installed at the rear portion of a storage chamber to supply cool air, heat-exchanged with the evaporator, to the storage chamber, or may be a direct type refrigerator in which a refrigerant pipe of an evaporator is wound on the external surface of a storage chamber to supply heat of the evaporator directly to the storage chamber.

A configuration of such a refrigerating cycle is well known in general, and a detailed description thereof will thus be omitted.

The first storage chamber door 20, the second storage chamber door 14, and the third storage chamber door 15 are respectively provided on the front surfaces of the first to third storage chambers 11, 12, and 13. The first storage chamber door 20 is hinged to the main body 10 and is rotated to open and close the first storage chamber 11, and the second and third storage chamber doors 14 and 15 are slidably provided on the main body 10 and are slid to open and close the second and third storage chambers 12 and 13.

A plurality of racks 16*a*, 16*b* and 16*c* vertically dividing the inside of the first storage chamber 11 to efficiently and separably store various articles is disposed in the first storage chamber 11. A sub door 30 to allow stored articles to be withdrawn without opening of the first storage chamber door 20, which opens and closes an opening 11*a* of the first storage chamber 11, is provided in front of one storage space 17 of storage spaces divided from each other by the plural racks 16*a*, 16*b* and 16*c*.

The lower rack 16*c* maintains a height about equal to that of the height of the rear surface of the sub door 30 when the sub door 30 is opened, thereby enabling articles stored in the storage space 17 to be easily withdrawn.

The sub door 30 serves to enable the articles stored in the first storage chamber 11 to be withdrawn without opening of the first storage chamber door 20. An opening 21 having a size corresponding to the sub door 30 is formed through the first storage chamber door 20 so as to allow the storage space 17 formed by the racks 16*b* and 16*c* to be communicated with the outside, when the sub door 30 is opened.

A stepped part 22 wider than the opening 21 by a designated width is provided at the edge of the front portion of the opening 21.

Hinge holes 22*a* to rotatably fix the sub door 30 are formed at the lower portions of the side surfaces of the stepped part 22, and a hook insertion hole 22*b* to allow the sub door 30 to be opened and closed is formed on the upper portion of the stepped part 22. The rear surface portion of the sub door 30 is formed in a size and a shape corresponding to the opening 21, and the front surface portion of the sub door 30 is formed in a size corresponding to the stepped part 22.

Hinge protrusions 31*a* corresponding to the hinge holes 22*a* of the stepped part 22 are formed on the lower ends of the side surfaces of the sub door 30, and a hook 31*b* corresponding to the hook insertion hole 22*b* is formed on the upper portion of the rear surface of the sub door 30 so as to allow the sub door 30 to be opened and closed.

The sub door 30 is vertically rotated to be opened and closed. When the sub door 30 is opened, the sub door 30 is supported in the horizontal direction and functions as a rack on which food is placed.

The sub door 30 is hinged to the stepped part 22, and the upper end of the sub door 30 is rotated about the lower end of the sub door 30, thereby opening and closing the opening 21.

The sub door 30, as shown in FIG. 5, includes a frame 32 provided with closed upper, lower, left, and right surfaces and openings 37 and 36 formed on front and rear surfaces thereof, a front panel 33 closing the front opening 37 of the frame 32 and forming the front surface of the sub door 30, a cooling unit 50 closing the rear opening 36 of the frame 32 and made of a material having a higher heat capacity than the frame 32 made of an injection molded product, and a connection member 40 (with reference to FIG. 2) slidably provided on the rear surface of the sub door 30 to prevent a height difference between the opening 21 and the rear surface of the sub door 30 when the sub door 30 is opened.

For example, the front panel 33 is made of tempered glass printed with a decorative pattern. Further, the front panel 33 may be made of metal or other materials.

The frame 32 is obtained by injection molding using a resin material. As shown in FIG. 5, the front panel 33 is attached to the edge of the front opening 37, and the cooling unit 50 is attached to the edge of the rear opening 36.

Double-sided adhesive tapes or other adhesive materials are provided on the edges of the front opening 37 and the rear opening 36, thereby fixing the front panel 33 and the cooling unit 50 to the frame 32.

A foamed material fills the above sub door 30, thereby forming a heat insulating layer.

Further, the frame 32 includes a first plane 34 contacting the stepped part 22 of the opening 21, and a second plane 35 protruded from the first plane 34 and inserted into the opening 21.

The connection member 40 is disposed on the lower portion of the rear surface of the sub door 30 such that the connection member 40 is vertically slidable. A pair of bending parts 41 which is bent downwardly so as to surround the rear surface of the sub door 30 is formed on both sides of the connection member 40, and guide protrusions 42 to guide the sliding movement of the connection member 40 relative to the rear surface of the sub door 30 are provided on the inner surfaces of the upper portions of the bending parts 41.

Guide holes 31*c* elongated to guide the rectilinear movement of the guide protrusions 42 of the connection member 40 are provided on both sides of the rear surface of the sub door 30.

Rotating protrusions 43 to rotatably fix the connection member 40 are formed on the outer surfaces of the lower portions of the bending parts 41 of the connection member 40. Rotating holes 21*a* corresponding to the rotating protrusions 43 are formed at the lower portions of both side surfaces of the opening 21.

Therefore, when the sub door 30 is vertically rotated, the connection member 40 is vertically rotated in connection with the rotation of the sub door 30, and performs a vertical sliding movement relative to the rear surface of the sub door 30.

The cooling unit 50 may be a cooling plate 51 made of a metal panel having a higher heat capacity than the resin material. For example, the cooling plate 51 is made of stainless steel.

The cooling plate 51 is mounted on the second plane 35 of the frame 32, and is exposed to the outside.

The cooling plate 51 includes a first stepped plane 51*a*, and a second stepped plane 51*b* lower than the first stepped plane 51*a*. The connection member 40 performs the sliding movement along the second stepped plane 51*b*.

Therefore, when the sub door 30 is closed, the connection member 40 performs the sliding movement relative to the sub door 30 and thus closes the second stepped plane 51*b*, and when the sub door 30 is opened, the connection member 40 performs the sliding movement relative to the sub door 30 and thus opens the second stepped plane 51*b*.

The cooling unit 50 further includes a cold storage pack 52 containing a liquid material, the phase of which is changeable.

The liquid material, i.e., a cold storage material, is a liquid material, the phase of which is changeable. Alcohol, an aqueous sodium chloride solution, a chemical material containing polyethylene glycol or polyvinyl alcohol, or a mixture of the chemical material and water or alcohol may be used as the cold storage material. Further, a metal or a solid material having high specific heat and thermal conductivity may be used as the cold storage material.

The cold storage pack 52 is provided integrally with or separately from the cooling unit 50, and then is fixed to the frame 32.

Therefore, when the sub door 30 is opened, if a stored article is placed on the rear surface of the opened sub door 30, the cooling unit 50 provided on the sub door 30 transmits cool air of the article placed on the rear surface of the sub door 30.

Further, when the sub door 30 is closed, the cooling unit 50 lowers the temperature of the opening 21 of the door 20 which is relatively high, thereby achieving relatively uniform temperature distribution in the storage chamber and thus improving storage performance of the refrigerator.

Now, a manufacturing method of the sub door of the refrigerator in accordance with this embodiment will be described.

First, the frame 32 provided with the front and rear openings 37 and 36 on the front and rear surfaces thereof and having a size corresponding to the door 20 is prepared, the front panel 33 forming the front surface of the sub door 30 is fixed to the edge of the front opening 37 of the frame 32, the cooling unit 50 made of a material having a higher heat capacity than the injection molded product forming the frame 32 is fixed to the rear opening 36 of the frame 32, and the inside of the sub door 30 formed by the frame 32, the front panel 33, and the cooling unit 50 is filled with a foamed material so as to attach the frame 32, the front panel 33, and the cooling unit 50 to each other by means of the foamed material.

Here, in order to reinforce the sub door 30, a reinforcing member (not shown) may be provided at the inside of the sub door 30.

In order to fix the front panel 33 to the edge of the front opening 37 of the frame 32, the front panel 33 is attached to the edge of the front opening 37 using a double-sided adhesive tape 62. Further, in order to fix the cooling unit 50 to the rear opening 36 of the frame 32, the edge of the cooling unit 50 is attached to the edge of the rear opening 36 using a double-sided adhesive tape 61.

Here, in addition to the above double-sided adhesive tapes 61 and 62, various adhesive agents may be used to attach the front panel 33 and the cooling unit 50 to the frame 32.

Next, an opening and closing operation of the sub door of the refrigerator in accordance with this embodiment will be described with reference to FIGS. 3 and 4.

In the refrigerator in accordance with this embodiment, the connection member 40 maintains a state of completely closing the second stepped plane 51*b* under the condition that the sub door 30 is closed. Then, when the sub door 30 is opened, the sub door 30 is rotated downwardly using the hinge protrusions 31*a* as a rotary axis. Here, the connection member 40 is rotated using the rotating protrusions 43 as a rotary axis in connection with the rotation of the sub door 30.

Since the center of rotation of the sub door 30 differs from the center of rotation of the connection member 40, when the sub door 30 is opened, the connection member 40 is rotated in connection with the rotation of the sub door 30 and thus performs a sliding movement in a direction of exposing the second stepped plane 51*b*.

Thereafter, when the sub door 30 continues to be rotated, the rear surface of the sub door 30 is located at a position higher than a lower surface 21*b* of the opening 21. At this time, the connection member 40 is rotated at an angle of about 90 degrees about the rotating protrusions 43, and is located above the lower surface 21*b* of the opening 21, thereby preventing a height difference between the sub door 30 and the opening 21.

Further, when the sub door 30 is closed, the connection member 40 is rotated in connection with the upward rotation of the sub door 30 and thus performs a sliding movement in a direction of closing the second stepped plane 51*b*. Thereby, as shown in FIG. 3, the sub door 30 closes the opening 21 under the condition that the connection member 40 closes the second stepped plane 51*b*.

Figure 6:
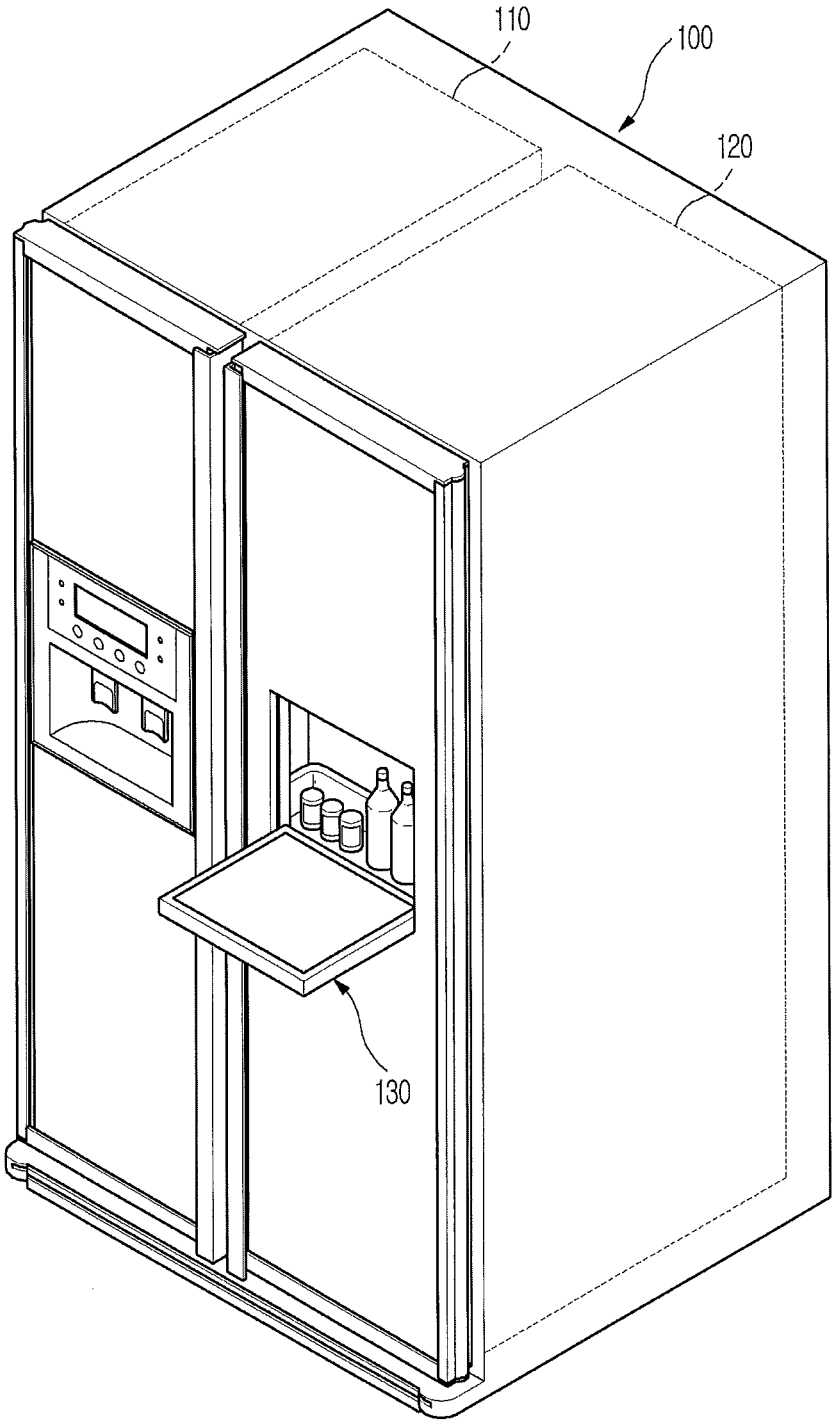
FIG. 6 is a perspective view illustrating a schematic configuration of a refrigerator in accordance with another embodiment.

FIG. 6 is a perspective view illustrating a schematic configuration of a refrigerator in accordance with another embodiment.

The embodiment of the present invention, as shown in FIGS. 1 to 5, illustrates a stand type kimchi refrigerator. On the other hand, the embodiment shown in FIG. 6 illustrates a side-by-side refrigerator in which a main body 100 is horizontally divided into storage chambers such that one storage chamber is used as a freezing chamber 110 and the other storage chamber is used as a refrigerating chamber 120. As shown in FIG. 6, the side-by-side refrigerator may also employ a sub door 130 in accordance with the embodiment.

As is apparent from the above description, in a refrigerator having a sub door and a manufacturing method of the sub door in accordance with one embodiment, a cooling unit provided on the sub door transmits cool air of the cooling unit to a stored article put on the rear surface of the sub door, when the sub door is opened.

Further, the cooling unit lowers the temperature of an opening of a main door which is relatively high, when the sub door is closed, thereby achieving relatively uniform temperature distribution in a storage chamber and thus improving storage performance of the refrigerator.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body provided with storage chambers formed therein;

doors opening and closing the storage chambers, one of the doors being provided with an opening, the opening having at least one stepped plane;

a rack installed in the storage chamber at a height corresponding to that of the lower end of the opening;

a sub door to open and close the opening; and a connection member to prevent a height difference between a rear surface of the sub door and the opening when the sub door is opened, wherein the connection member is configured to slide relative to the sub door to cover the at least one stepped plane, whereby the connection member closes the at least one stepped plane when the sub door is closed, and opens the at least one stepped plane when the sub door is opened so that the rear surface of the sub door and the connection member form substantially a level plane with the rack, and thus an article placed on the rack is moved in a horizontal direction through the opening of the door and then placed on the rear surface of the sub door.

2. The refrigerator according to claim 1, wherein the connection member slides on the rear surface of the sub door based on opening and closing of the sub door.

3. The refrigerator according to claim 1, wherein the refrigerator is a kimchi refrigerator to store kimchi.

4. The refrigerator according to claim 1, wherein the storage chambers provided in plural number are vertically divided from each other, and the sub door is provided on the door to open and close the upper storage chamber out of the plural storage chambers.

5. The refrigerator according to claim 1, wherein the storage chambers provided in plural number are horizontally divided from each other, and the number of the doors is equal to the number of the storage chambers.

6. The refrigerator according to claim 1, wherein the sub door has a thickness corresponding to a thickness of the doors when viewed from overhead.

7. A refrigerator comprising:

a main body provided with storage chambers formed therein;

doors opening and closing the storage chambers, one of the doors being provided with an opening, the opening having at least one stepped plane;

a rack installed in the storage chamber at a height corresponding to that of the lower end of the opening;

a sub door having a thickness corresponding to that of the doors so as to open and close the opening; and a connection member to prevent a height difference between a rear surface of the sub door and the opening when the sub door is opened;

wherein the connection member is configured to slide relative to the sub door to cover the at least one stepped plane, whereby the connection member closes the at least one stepped plane when the sub door is closed, and opens the at least one stepped plane when the sub door is opened so that the rear surface of the sub door and the connection member form substantially a level plane with the rack.

* * * * *